US007207441B2

(12) United States Patent
Ritter

(10) Patent No.: US 7,207,441 B2
(45) Date of Patent: Apr. 24, 2007

(54) BLISTER DISPLAY PACKAGE HAVING TEAR-RESISTANT SECURITY TAPE

(75) Inventor: Karl Ritter, Geneva, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 140 days.

(21) Appl. No.: 10/945,192

(22) Filed: Sep. 20, 2004

(65) Prior Publication Data

US 2006/0016717 A1 Jan. 26, 2006

Related U.S. Application Data

(63) Continuation-in-part of application No. 10/897,907, filed on Jul. 23, 2004, now abandoned.

(51) Int. Cl.
*B65D 73/00* (2006.01)

(52) U.S. Cl. ..... 206/470; 206/462; 206/807

(58) Field of Classification Search ..... 206/461–463, 206/470–471, 807; 229/939–940
See application file for complete search history.

(56) References Cited

U.S. PATENT DOCUMENTS 4,896,770 A * 1/1990 Calcerano et al. ..... 206/461
4,938,352 A * 7/1990 Calcerano et al. ..... 206/705
6,332,537 B1 * 12/2001 Usui et al. ..... 229/940
6,691,870 B1 * 2/2004 Palm et al. ..... 206/462
7,051,876 B2 * 5/2006 Grosskopf ..... 206/462
2004/0040880 A1 * 3/2004 Grosskopf ..... 206/461

* cited by examiner

*Primary Examiner*—Bryon P. Gehman
(74) *Attorney, Agent, or Firm*—Armstrong Teasdale LLP

(57) ABSTRACT

Display packaging constructions incorporating a plastic blister cavity, sandwiched between layers of paperboard material, preferably corrugated paperboard material, are disclosed. Variations of the basic construction include a high-density packaging configuration, display packages having security features for precluding unauthorized access to the interior of the display package, and a reclosable construction to enable the display package to be used as a storage container. When corrugated paperboard is used for the layers, the corrugations may be arranged to extend transversely to one another, to resist warping caused during the heat sealing process. A plastic blister construction is provided, having a forward stabilizing foot, and a rear concavity, for receiving a similar foot from a like blister, for facilitated nested packing together of pluralities of such blisters.

10 Claims, 13 Drawing Sheets

BLISTER DISPLAY PACKAGE HAVING TEAR-RESISTANT SECURITY TAPE

This application is a continuation-in-part, and claims priority, of the filing date of U.S. Ser. No. 10/897,907, filed 23 Jul. 2004, now abandoned.

BACKGROUND OF THE INVENTION

1. The Technical Field

The present invention is directed to reusable packaging that is configured to initially display and then house the product, while the product is completely encased in the package, and then house the product repeatedly thereafter, wherein the product is at least partially enclosed by a transparent or translucent blister cavity, and wherein the blister cavity is usually fabricated from a plastic material.

2. The Prior Art

Typical prior art display package constructions are often in the form of an all-plastic enclosure, often in the form of a clamshell. That is, the plastic enclosure will be formed as a front portion and a rear portion, on or both of which may be generally planar, but have one or more contoured, three-dimensional bubbles or blister cavities formed therein, into which a portion or all of the product to be packaged, is received. The front and rear portions may be initially hinged along a common edge, which may be a top, bottom or side edge. After placement of the product into the bubble or blister cavity, the front and rear portions are then folded about the hinge and snap-fitted together via complementary snap joining structures formed in the respective front and rear portions. Alternatively, the front and rear portions may be sealed to each other, e.g., by heat or sonic welding. Other joining techniques may also be employed.

In other prior art constructions, the front and rear portions of the all-plastic enclosure may be completely separate structures, which are snap-fitted, sealed together, or otherwise joined, after placement of the product in the blister cavity.

Alternatively, prior art display package constructions may incorporate a plastic blister cavity, usually having flat flanges which extend outwardly from peripheral edges of the contoured three-dimensional portion of the blister. The flanges are then affixed to one or more layers of paperboard or other material. For example, the blister may be affixed to a single layer of paperboard material or "card" which forms the rear wall of the product enclosure.

In a still further alternative prior art construction, the contoured, three-dimensional portion of the blister may be pushed through a suitably shaped opening in a front "card". A rear "card" having dimensions usually the same as the overall dimensions of the front card, may be placed in a position overlying the rear surfaces of the blister flanges and rear surface of the front card, so that the blister flanges are sandwiched between the front and rear cards.

Often, such display package constructions, are configured to hang from hooks, rods or pegs from shelving or upright supports, by providing one or more apertures, usually adjacent an upper edge region of the package.

Among the prior art display package constructions are the following references:

Jacobson et al., U.S. Pat. No. 3,250,387. In this reference, an all-plastic blister package is provided with a back snap closure.

Tjaden, U.S. Pat. No. 3,397,774 discloses reclosable, all-plastic blister cavities with hinged backs/bottoms with contoured snap features that interfit with corresponding structures in the cavity wall.

Iten et al., U.S. Pat. No. 3,972,417. A package for safety razor blades, in which a pivotable card-stock panel in the card back is located behind the open-backed blister cavity. In one embodiment, plastic cup-shaped structures affixed to the panel telescopically receive posts extending backward from the front wall of the blister cavity, to hold the blades in place.

Yeager et al., U.S. Pat. No. 5,353,935. A open-backed blister cavity is affixed to the bottom half of a card back. The top half of the card back is pivotable relative to the blister cavity, and bumps on the interior of the top of the blister cavity engage the top edges of the card back to hold it in place, once the package has been initially opened.

Shimizu et al., U.S. Pat. No. 5,984,099. This reference discloses a blister pack with foldable front and back card panels, and a blister bubble, that appears to be affixed, first to the front card panel by heat and pressure, with the front and back card panels attached to each other. However, it is to be noted that the English text appears to be a very rough translation from the Japanese, and so the details are given somewhat inconsistently. An alternative embodiment is disclosed where all three layers are heat sealed together simultaneously. The packages appear to be reclosable after opening. Most of the embodiments feature a back card hinged to the front card, being released by a tear strip or zipper strip, and then held in place by tucking the free edge of the back card under a die-cut tab formed in the front card.

Mickel, U.S. Pat. No. 6,523,689 B2. A package has an open-backed blister cavity with a removable and replaceable card back. An aperture in the card back fits over one or more protuberances on the blister cavity. The protuberances may be formed to create a "snap" fit with the card back.

One disadvantage of such prior art display package constructions, particularly the combination paperboard/plastic display packages, is that by simply tearing the card(s), it is often possible to separate the blister from the card(s) and/or otherwise gain access to the blister cavity, enabling the product therein to be removed and stolen.

It would be desirable to provide an improved combination paperboard/plastic display package construction that is provided with security features for discouraging or inhibiting theft of products from within the blister cavities of such display package constructions.

It would also be desirable to provide an improved display package construction that can be reused as a storage container for the product purchased.

It would also be desirable to provide an improved display package construction which has enhanced resistance to warping, which might otherwise result during the process of sealing the plastic blister to the paperboard card(s).

These and other desirable characteristics and objects of the present invention will become apparent in view of the present specification, including claims, and drawings.

SUMMARY OF THE INVENTION

The present invention comprises, in part, a display package for the containment and display of at least one product for sale. The display package, according to one embodiment, comprises a blister cavity, having a contoured, three-dimensional portion operably configured to receive the at least one product, and through which the at least one product may be visually inspected. The blister cavity further has a peripheral flange extending outwardly from at least a portion of the contoured, three-dimensional portion. A front card is provided, having an aperture, through which the contoured, three-dimensional portion of the blister cavity projects, and further having a rearwardly facing surface, against which a forwardly facing surface of the peripheral flange is juxtaposed. A rear card is provided, having a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is preferably fabricated from a material that is at least one of transparent, translucent. The front and rear cards are preferably fabricated from a material that is at least one of paper, paperboard, corrugated paperboard. The rear card further preferably has an access door formed therein, the access door further comprising a flap cut from a portion of the rear card material and pivotably connected thereto. A releasable locking mechanism preferably interconnects the access door and the blister cavity, for enabling the access door to repeatedly opened and closed, for enabling storage of the product in the display package.

The releasable locking mechanism preferably comprises a snap member, extending rearwardly from a rearward facing surface of the peripheral flange of the blister cavity; and a snap aperture, disposed in an edge region of the access door, and operably configured to receive, in a snap-fit manner, the snap member.

The blister cavity is preferably fabricated from a plastic material. The front and rear cards are preferably fabricated from corrugated paperboard material. The corrugated paperboard material is preferably single wall corrugated paperboard material. At least one tear-resistant security tape may be embedded within the corrugated paperboard material forming at least one of the front and rear cards, for precluding tearing the front and rear cards so as to enable unauthorized access to the blister cavity.

Preferably, the front card is sealed to a forwardly-facing surface of the peripheral flange of the blister cavity, and the rear card is sealed to a rearwardly-facing surface of the peripheral flange of the blister cavity.

A line of weakness may be disposed in the rearwardly facing surface of the front card, the line of weakness encircling and outwardly spaced from the peripheral flange of the blister cavity, whereupon attempted forced separation of the front card from the rear card, the line of weakness causes portions of the front card that are sealed to the peripheral flange of the blister cavity that are encircled by the line of weakness to separate from remaining portions of the front card that are not encircled by the line of weakness, to inhibit unauthorized access to the blister cavity.

The present invention is also directed to a high-density display packaging system, comprising at least two complementary display packages. Each display package includes a blister cavity, having a contoured, three-dimensional portion operably configured to receive the at least one product, and through which the at least one product may be visually inspected. The blister cavity further preferably has a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is preferably fabricated from a material that is at least one of transparent, translucent, while the front and rear cards are preferably fabricated from a material that is at least one of paper, paperboard, corrugated paperboard.

The rear card further has an access door formed therein, the access door further comprising a flap cut from a portion of the rear card material and pivotably connected thereto. At least one of the display packages has a first configuration such that the front and rear cards form a main body portion enclosing a blister cavity, and a wing portion extending away from an upper left side region of the main body portion. At least one of the display packages has a second configuration such that the front and rear cards form a main body portion enclosing a blister cavity, and a wing portion extending away from an upper right side region of the main body portion. A display package of a first configuration has a recess therein defined by the wing portion thereof, through which the blister cavity of a display package of the second configuration may be visually inspected; a display package of a second configuration having a recess therein defined by the wing portion thereof, through which the blister cavity of a display package of the first configuration may be visually inspected. A shipping and display case is operably configured to receive, in a row from front to back, alternating ones of the display packages whereupon a display package of the first configuration is preceded or followed by a display package of the second configuration, and a display package of the second configuration is preceded or followed by a display package of the first configuration.

The present invention also comprises a display package for the containment and display of at least one product for sale, wherein the display package comprises a blister cavity, having a contoured, three-dimensional portion operably configured to receive the at least one product, and through which the at least one product may be visually inspected. The blister cavity further has a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is fabricated from a material that is at least one of transparent, translucent; while the front and rear cards being fabricated from a material that is at least one of paper, paperboard, corrugated paperboard. At least one tear-resistant security tape is embedded within the corrugated paperboard material forming at least one of the front and rear cards, for precluding tearing the front and rear cards so as to enable unauthorized access to the blister cavity.

In another embodiment of the invention, a display package for the containment and display of at least one product for sale comprises a blister cavity, having a contoured, three-dimensional portion operably configured to receive the at least one product, and through which the at least one product may be visually inspected. The blister cavity further having a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is preferably fabricated from a material that is at least one of transparent, translucent, while the front and rear cards are fabricated from a material that is at least one of paper, paperboard, corrugated paperboard. The front card is preferably sealed to a forwardly-facing surface of the peripheral flange of the blister cavity, and the rear card is sealed to a rearwardly-facing surface of the peripheral flange of the blister cavity.

In still another embodiment of the invention, a display package is provided for the containment and display of at least one product for sale. A blister cavity has a contoured, three-dimensional portion operably configured to receive the at least one product, and through which the at least one product may be visually inspected. The blister cavity further has a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is preferably fabricated from a material that is at least one of transparent, translucent. The front and rear cards are preferably fabricated from a material that is at least one of paper, paperboard, corrugated paperboard. A line of weakness may be disposed in the rearwardly facing surface of the front card, the line of weakness encircling and outwardly spaced from the peripheral flange of the blister cavity, whereupon attempted forced separation of the front card from the rear card, the line of weakness causes portions of the front card that are sealed to the peripheral flange of the blister cavity that are encircled by the line of weakness to separate from remaining portions of the front card that are not encircled by the line of weakness, to inhibit unauthorized access to the blister cavity.

The invention also comprises a display package for the containment and display of at least one product for sale, in which the display package comprises a blister cavity, having a contoured, three-dimensional portion operably configured to receive the at least one product, and through which the at least one product may be visually inspected. The blister cavity further has a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is fabricated from a material that is at least one of transparent, translucent. The front and rear cards is fabricated from a material that is at least one of paper, paperboard, corrugated paperboard. The peripheral flange of the blister cavity is sealed, along at least portions thereof, to the respective adjacent front and rear cards.

The blister cavity may include a front section hingedly connected to a rear section. In this embodiment, the rear section of the blister cavity also includes contoured, three-dimensional portion operably configured to receive the at least one product, and through which the at least one product may be visually inspected, and the rear card includes an aperture through which the three-dimensional portion of the blister cavity projects.

The blister cavity may also include at least one downwardly projecting portion which supports the display package to enable the display package to be positioned in a freestanding upright configuration.

The present invention also comprises a display package, comprising a blister cavity, having a contoured, three-dimensional portion operably configured to receive at least one product, and through which the at least one product may be visually inspected. The blister cavity further has a peripheral flange extending outwardly from at least a portion of the contoured, three-dimensional portion. A front card has an aperture, through which the contoured, three-dimensional portion of the blister cavity projects, and further having a rearwardly facing surface, against which a forwardly facing surface of the peripheral flange is juxtaposed. A rear card has a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards. The blister cavity is fabricated from a material that is at least one of transparent, translucent. The front and rear cards are each fabricated at least in part from corrugated paperboard. The corrugations of the corrugated paperboard of the front card extend transversely to the corrugations of the corrugated paperboard.

In a preferred embodiment of the invention, the corrugations of the corrugated paperboard of the front card extend perpendicular to the corrugations of the corrugated paperboard of the rear card.

The present invention also comprises a plastic blister for a display package. The blister comprises a front, contoured, three-dimensional outwardly projecting portion, configured to receive at least a portion of at least one product to be displayed; and a rear, contoured, three-dimensional outwardly projecting portion, configured to receive at least another portion of at least one product to be displayed. The front, contoured, three-dimensional outwardly projecting portion includes a further outwardly projecting stabilizing foot having an outer contour. The rear, contoured, three-dimensional outwardly projecting portion further includes a concavity having an inner contour configured to insertingly receive a further outwardly projecting stabilizing foot of another similarly constructed plastic blister.

The stabilizing foot preferably has a width which is less than a width of the front, contoured, three-dimensionally outwardly projecting portion.

The concavity preferably has a width which is less than a width of the rear, contoured, three-dimensional outwardly projecting portion.

The stabilizing foot and the concavity preferably have complementary outer and inner contours, to enable the stabilizing foot of one such blister to be nestingly received in the concavity of another such blister.

DETAILED DESCRIPTION OF THE INVENTION

Figure 1:
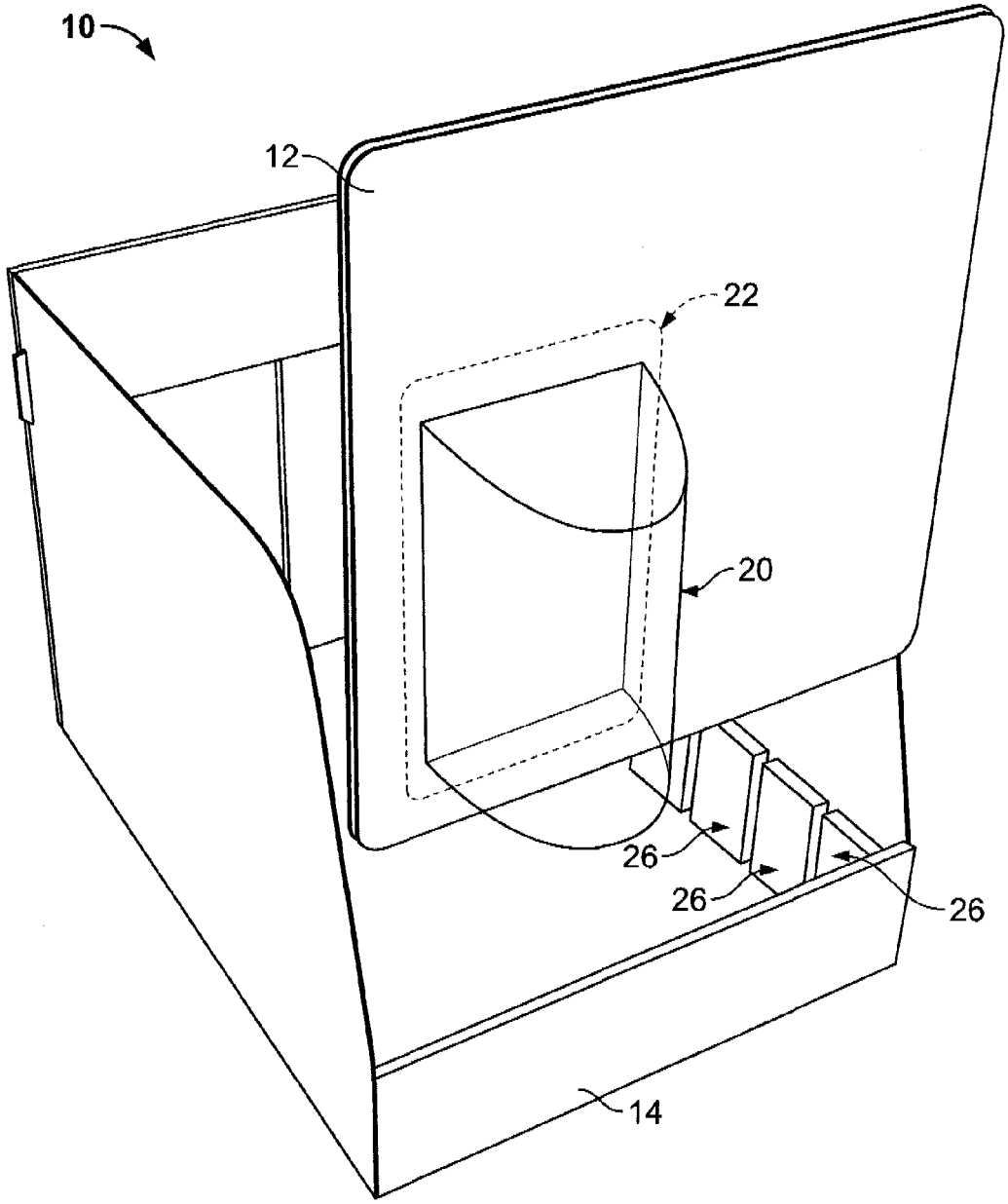
FIG. 1 is a perspective view of a display package, fabricated from a combination of paperboard and a plastic blister cavity, according to an embodiment of the invention, shown with a shipping carton, which has been converted into a display carton.

While this invention is susceptible of embodiment in many different forms, there is shown in the drawings and will be described in detail several specific embodiments, with the understanding that the present disclosure is to be considered an exemplification of the principles of the invention and is not intended to limit the invention to the embodiments illustrated.

Figure 2:
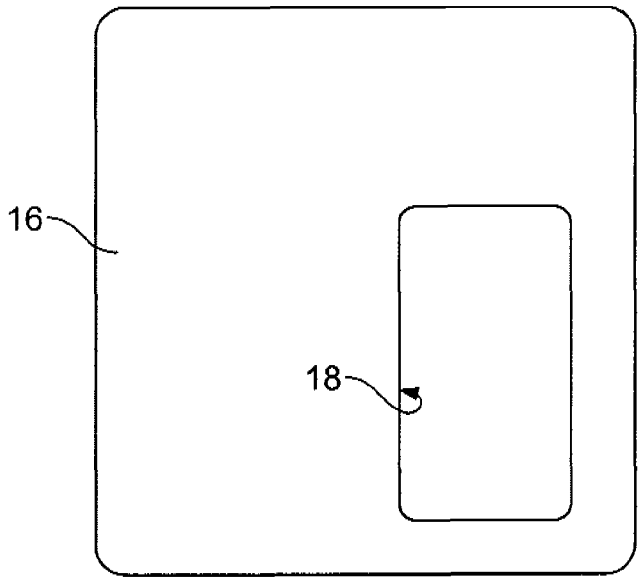
FIG. 2 is a plan view of a front card of the display package of the embodiment of FIG. 1.
Figure 3:
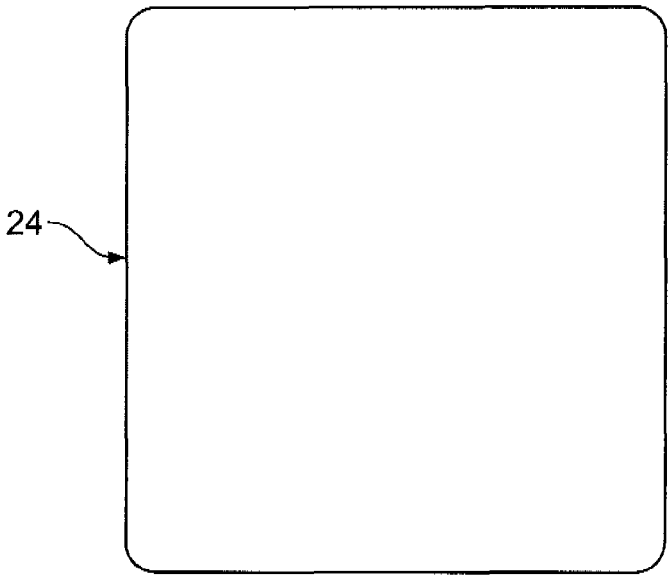
FIG. 3 is a plan view of a rear card of the display package of the embodiment of FIG. 1.

FIGS. 1–3 illustrate a display package system 10 according to an embodiment of the invention. System 10 comprises a combination corrugated paperboard/plastic display package 12, and a corrugated paperboard shipping container/display tray 14, for holding same.

In the embodiment of FIGS. 1–3, as in all of the embodiments described herein, the cards that form the structures supporting the blister cavities are preferably formed from (but not limited to) corrugated paperboard material, and in particular, preferably from (but not limited to) single-wall corrugated paperboard material (that is, a single layer of corrugated paperboard medium, sandwiched between single sheet layers of paper linerboard). Preferably, to serve interests of weight, size and cost, the gauge of the corrugated medium is relatively small, such as E or F flute, as such materials are referred to in the corrugated paperboard manufacturing industry.

Display package 12 incorporates front card 16 which is preferably fabricated of corrugated paperboard, which may bear product information indicia. Front card 16 has a cut-out opening 18 for receiving an otherwise conventional plastic blister cavity 20 (a concave bubble of whatever desired configuration, with a surrounding flange 22 shown in broken lines in FIG. 1). Back card 22 (FIG. 3) is also provided. Upon assembly of front card 16, blister cavity 20 and back card 24, so that flange 22 of blister cavity 20 is captured, completely around its perimeter, by front card 16 and back card 24—with the product (not shown) encapsulated between blister cavity 20 and the forward facing surface of back card 24. In addition, to enhance security against theft, all three packaging components (front card 16, blister cavity 20 and back card 24) are joined together with a heat-seal coating which is placed on the inside facing surfaces of front card 16 and back card 24, particularly in the area of flange 22 of blister cavity 20. This heat-seal coating may be one of any of a variety of coating materials that are suitable for heat sealing a plastic material to a paperboard material, such as SOLUCOTE® by Soluol Chemical Co., Inc. of West Warwick, R.I.

In FIGS. 1–3, shipping container/display tray 14 may be of any suitable configuration, and preferably is provided with a series of paired aligned slots 26, located on opposite interior sides of shipping container/display tray 14, which serve to capture opposite edges of display packages 12, to hold them in an upright orientation, when shipping container/display tray 14 is placed in a display location such as a retail store shelf.

Figure 15:
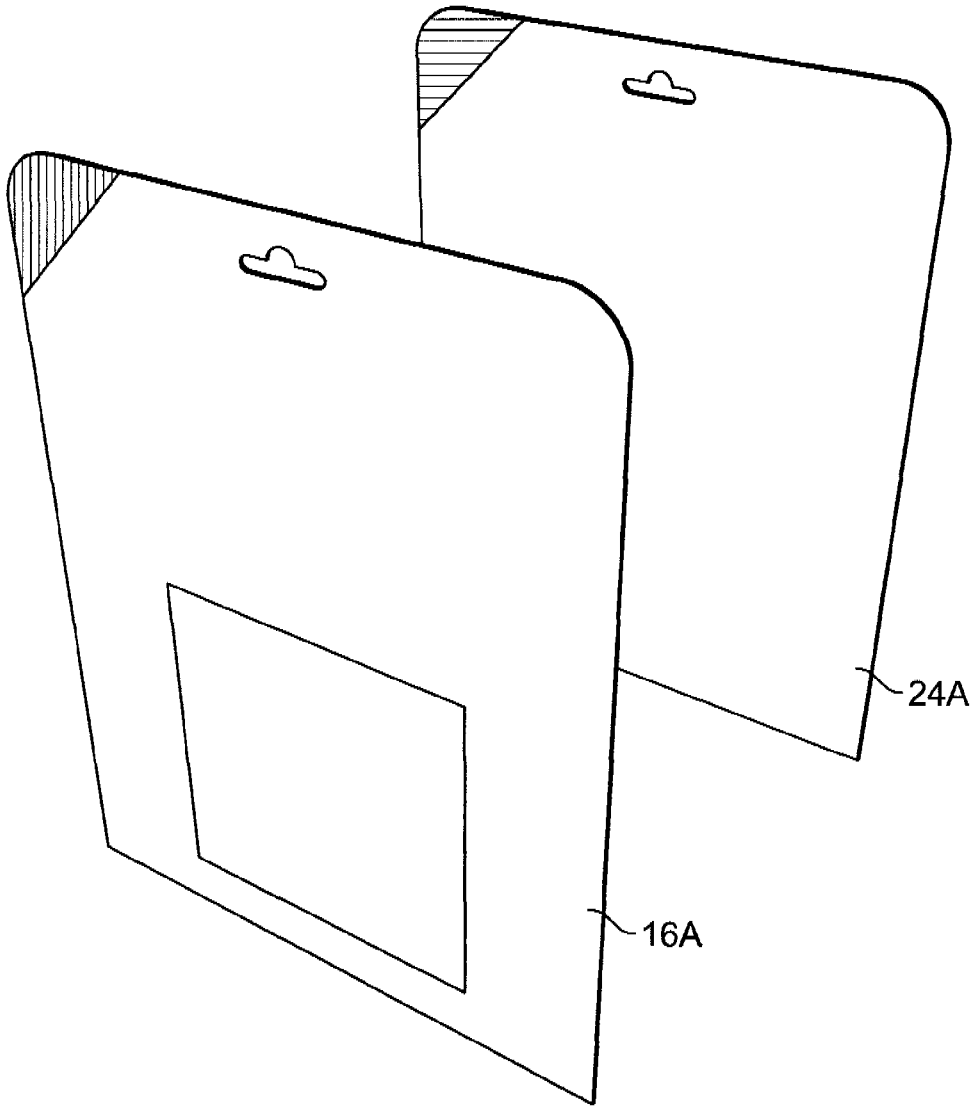
FIG. 15 is a perspective, exploded view of the paperboard cards for an alternative embodiment of the invention, in which the corrugations of the respective front and rear layers corrugated paperboard material, extend perpendicular to one another.

During the process of heat sealing the flange of the plastic blister to the front and rear cards (and the heat sealing of the front and rear cards to each other), heat-induced warping may occur. In an alternative preferred embodiment of the invention, shown in FIG. 15, the front card 16A and rear card 24A will be fabricated in such a way that the corrugations of the material of front card 16A will run perpendicular to the corrugations of the material of rear card 24A. By arranging the corrugations of the corrugated paperboard material in this manner, warping of the assembled cards, resulting from the heat sealing process, is lessened or eliminated.

An additional benefit from running the corrugations transverse (preferably perpendicular) to one another, is that the finished card has approximately equal strength in each of the transverse directions of the corrugations, whereas in a construction in which the corrugations of the front and rear cards are parallel, there would be a substantial difference in card strength, between the direction parallel to the corrugations, and in the direction transverse to the corrugations, the strength in the direction parallel to the corrugations being substantially greater than in the direction transverse to the corrugations.

While in a preferred embodiment of the invention, the corrugations of one of the cards extend "vertically" or parallel to side edges of the card, and the corrugations of the other of the cards extend "horizontally" or parallel to the top and/or bottom edges of the card, in further alternative embodiments of the invention, the corrugations may be transverse to each other, yet not parallel to any of the top, bottom or side edges of the respective cards, instead running diagonally to the cards' peripheral edges.

A space-saving alternative display package and system 100 is illustrated in FIGS. 4–7. Display package system 100 includes complementary display packages 101, 102, and a shipping container/display tray 104, which may have a configuration similar to that of shipping container/display tray 14 of the embodiment of FIGS. 1–3, or any other desired configuration, consistent with the particular features of display system 100. A representative blister cavity 105, having a flange 107 is shown in broken lines in display package 101. It is to be understood that preferably, identical blister cavities 105 are to be used with each display package 102, as well as each display package 101. Although blister cavities 105 may be of any desired configuration, in preferred embodiments of the invention, blister cavities are relatively shallow, that is, each blister cavity 105 has a depth (the dimension perpendicular to the paperboard cards) that is relatively less then its height or width (the dimensions parallel to the planes of the paperboard cards).

Figure 4:
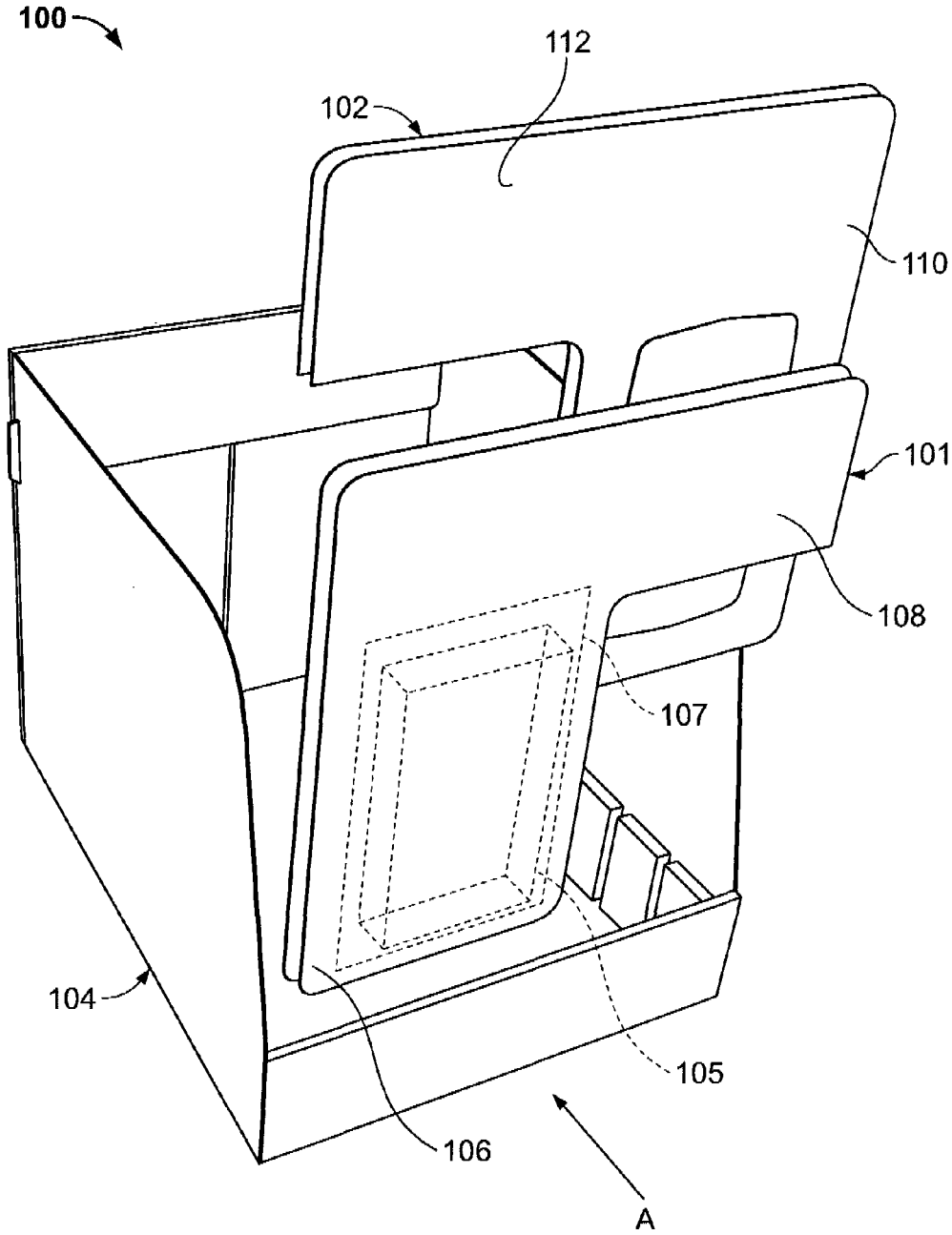
FIG. 4 is a perspective view of a pair of complementary display packages, fabricated from a combination of paperboard and plastic blister cavities, according to an alternative embodiment of the invention, shown with a shipping carton, which has been converted into a display carton.

Complementary display packages 101, 102, as can be seen in FIG. 4, have mirror-image L-shaped configurations. That is, display package 101 has a main body portion 106, which would contain the blister cavity (not shown), and an upper wing 108, which extends to the right, as seen in FIG. 4. Conversely, display package 102 has a main body portion 110, and an upper wing 112, which extends to the left, as seen in FIG. 4. The size and placement of the blister cavity 105 in each of display packages 101, 102, and the height of the respective wings 108, 112 are such that when a complementary pair of display packages 101, 102 are placed in a suitable shipping container/display tray 104, wing 108 extends in front of the upper portion of main body portion 110, preferably directly above portions of the blister cavity that is held in display package 102. Similarly, if there is another display package 101 (not shown) behind display package 102, wing 112 of display package 102 would extend in front of the upper portion of the main body portion 110 of that display package 101, preferably directly above the portions of the blister cavity held in that display package 101. In that way, the blister cavities 105 of each of display packages 101, 102 are both visible at the same time, regardless of which of display packages 101, 102 is in front of the other, when system 100 is viewed from the front (the direction of the arrow A in FIG. 4).

Figure 6:
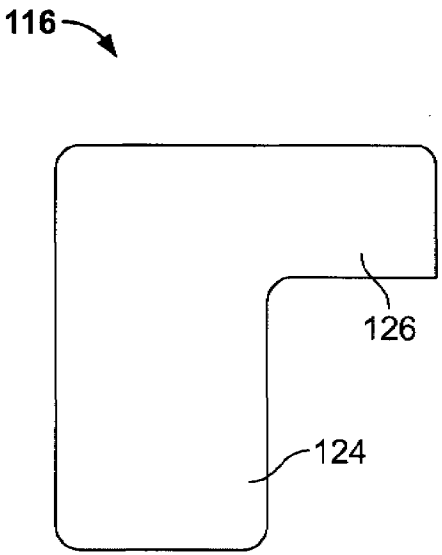
FIG. 6 is a plan view of a rear card for the display packages of the embodiment of FIG. 4.
Figure 5:
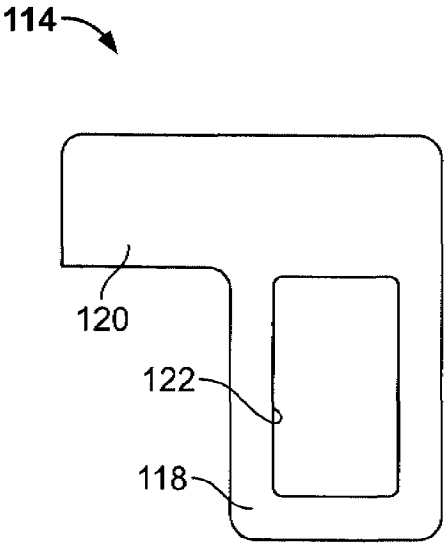
FIG. 5 is a plan view of a front card for the display packages of the embodiment of FIG. 4.

In principle, in a preferred version of the embodiment of FIG. 4, the front and rear cards that are used to form display packages 101, 102 are mirror-image symmetrical, so that, absent issues such as graphics printing, the same card, e.g., card 114 of FIG. 5, can serve as the front card for each of packages 101, 102, simply by flipping it over. Likewise, the same card, e.g., card 116 of FIG. 6, can serve as the rear card for each of packages 101, 102, simply by flipping it over. Front card 114 has a main body portion 118, wing 120, and aperture 122, through which the contoured portion of the blister cavity is received. Rear card 116 has a main body portion 124 and wing 126. It is to be understood that when a blister cavity is placed into a front card 114, and then rear card 116 (as shown in FIG. 6) is flipped over and placed over the rearwardly-facing surface of front card 114, the three components (front card, blister cavity and rear card) will preferably be sealed together, using the method of sealing described with respect to the embodiment of FIGS. 1–3.

Figure 7:
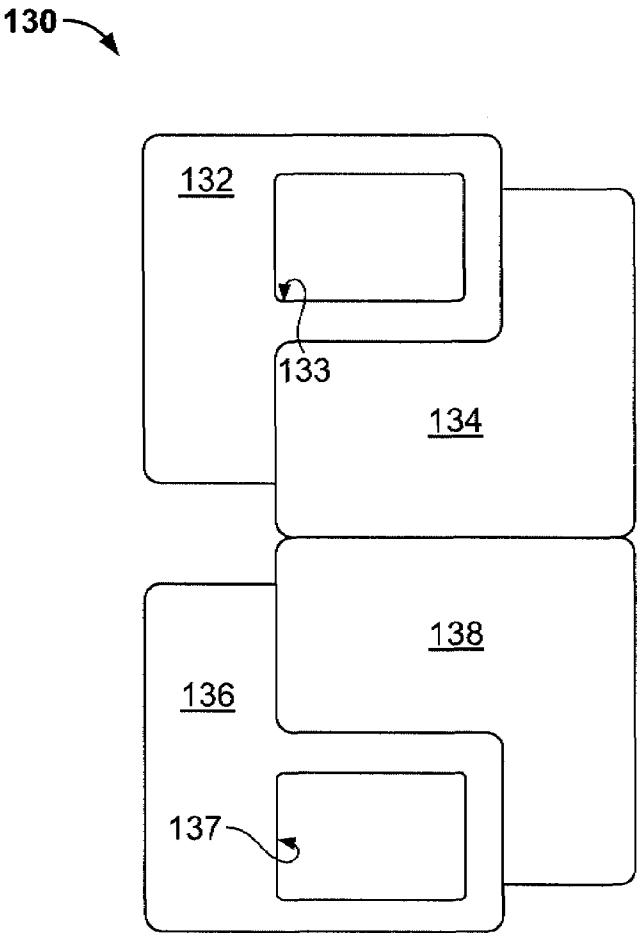
FIG. 7 is a plan view of a composite blank for forming complementary front and rear cards for the complementary display packages of the embodiment of FIG. 4, wherein the complementary front and rear cards are formed in a single die-cutting operation, for facilitated single-pass printing operations.

As a practical matter of manufacturability, it may be easier to print and die cut discretely separate front and rear cards for the complementary display packages 101, 102, rather than use the same dies, and simply flip over the front and rear cards of one or the other of packages 101, 102. That is, for interests of efficiency (which may be influenced by graphics printing considerations), to print the graphics of the front and rear cards in a single pass on a single contiguous expanse of paperboard material (preferably corrugated paperboard material). FIG. 7 illustrates an example of a layout 130 for front and rear cards. For example, presuming the surface of layout 130 that faces the viewer of FIG. 7 represents the "outside" surfaces of the cards, card 132 with aperture 133 can be the front card for a display package 102 and card 134 can be the rear card for a display package 104, while card 136 with aperture 137 can be the front card for a display package 101, and card 138 can be the rear card for a display package 101.

Figure 1A:
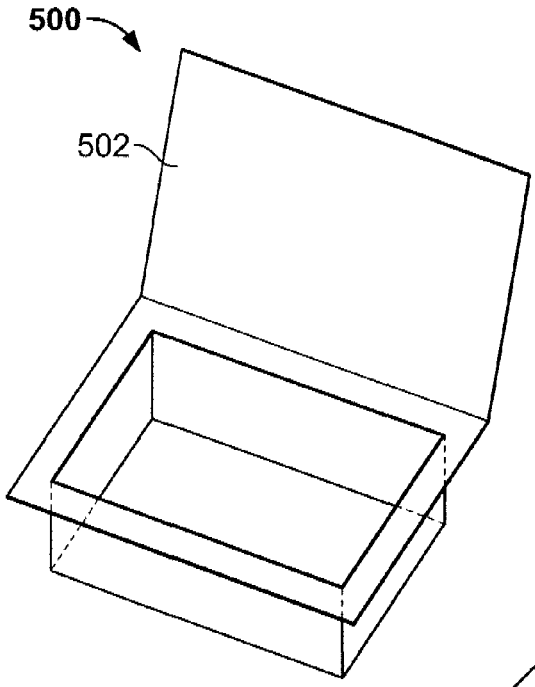
FIG. 1A is a perspective view of a plastic blister cavity, according to an alternative embodiment of the invention, wherein the plastic blister cavity has a hinged flat back wall.

Alternative variations of the plastic blister cavity may be employed without departing from the scope of the present invention. For example, FIG. 1A is a perspective view of a plastic blister cavity, according to an alternative embodiment of the invention, wherein the plastic blister cavity 500 has a hinged flat back wall 502.

Figure 1B:
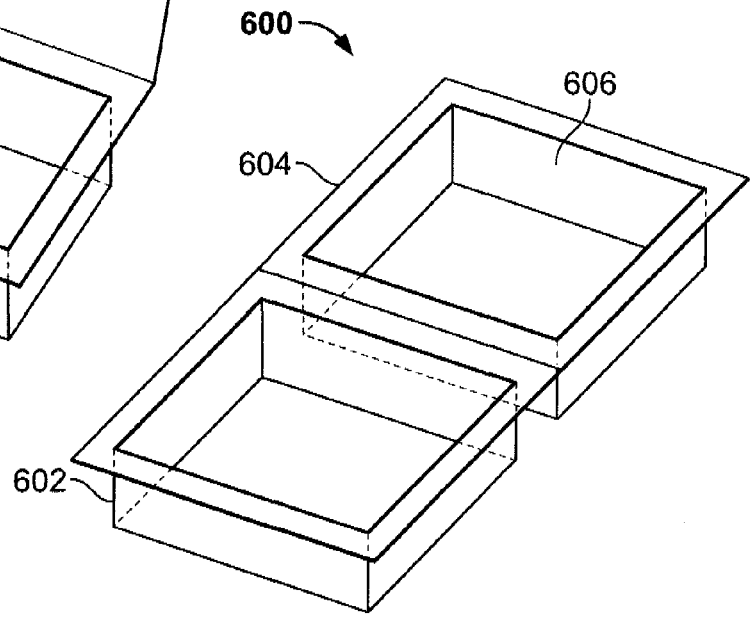
FIG. 1B is a perspective view of a plastic blister cavity according to another alternative embodiment of the invention, wherein the plastic blister cavity has a hinged contoured back wall.

FIG. 1B is a perspective view of a plastic blister cavity according to another alternative embodiment of the invention, wherein the plastic blister cavity 600 has, in addition to a front cavity portion 602, a hinged back wall 604 having a cavity 606.

Figure 1C:
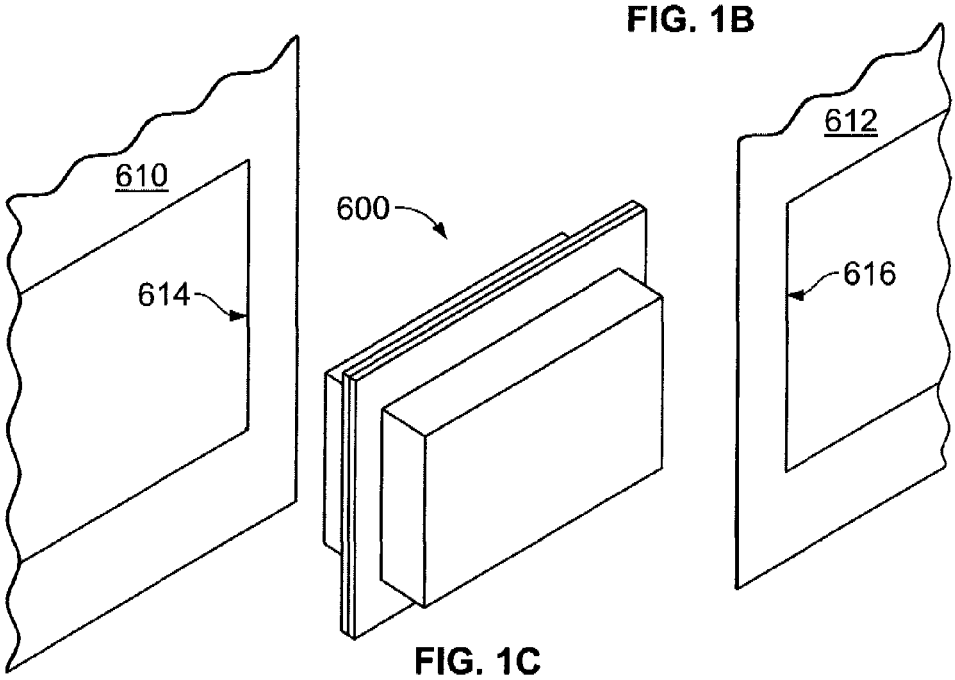
FIG. 1C is a perspective view of a package assembly, in an exploded view, employing a plastic blister cavity according to the embodiment of FIG. 1B, showing how the front (partially shown) and rear cards have apertures for accommodating the front and rear contoured portions of the plastic blister cavity.

FIG. 1C is a perspective view of a package assembly, in an exploded view, employing a plastic blister cavity according to the embodiment of FIG. 1B, showing how the front (partially shown) card 610 and rear card 612 have apertures 614, 616, respectively, for accommodating the front and rear contoured portions of the plastic blister cavity 600.

Figure 1D:
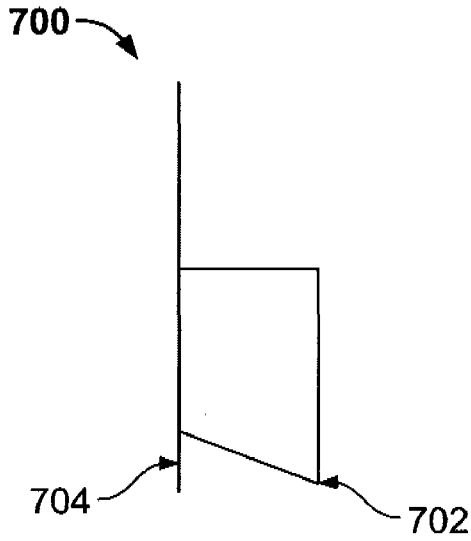
FIG. 1D is a side elevation of a plastic blister cavity according to an alternative embodiment of the invention, wherein the cavity features a downwardly projecting stabilizing portion, in coordination with the blister flange, for enabling the completed package to stand upright without reliance upon a shipping container for support.
Figure 1E:
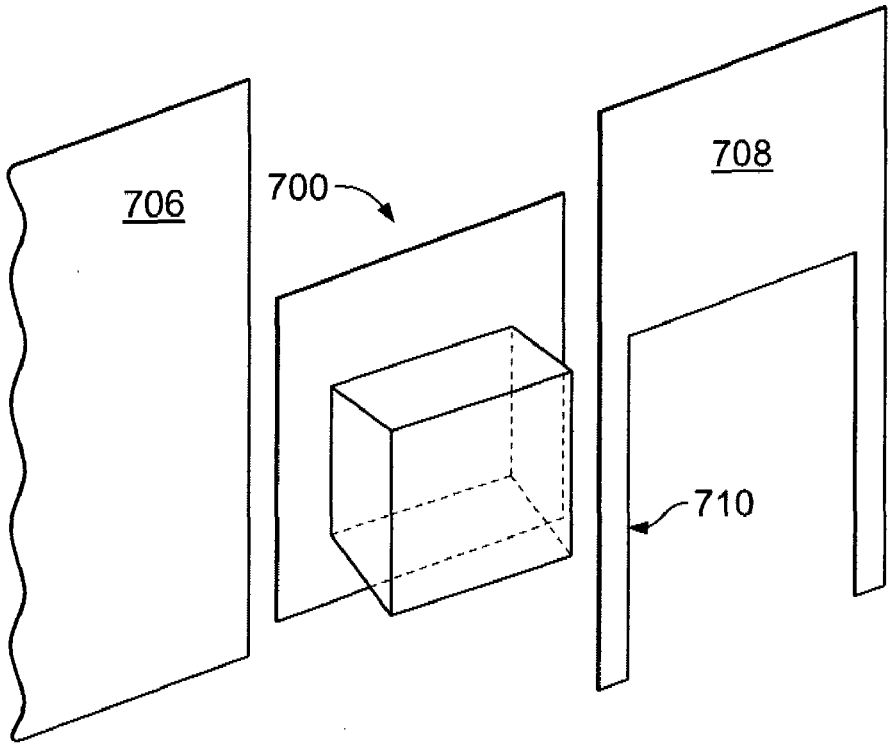
FIG. 1E is a perspective exploded view of a display package using the plastic blister cavity of FIG. 1D.

FIG. 1D is a side elevation of a plastic blister cavity according to an alternative embodiment of the invention, wherein the cavity 700 features a downwardly projecting stabilizing portion 702, in coordination with the blister flange 704, for enabling the completed package to stand upright without reliance upon a shipping container for support. FIG. 1E is a perspective exploded view of a display package using the plastic blister cavity 700 of FIG. 1D, between rear card 706 and front card 708 having aperture 710 (which may, but need not necessarily, be downward opening—depending upon whether the particular shape of the projecting blister can be inserted through the aperture without having to have one "edge" of the aperture being open). For practical manufacturing considerations, in this embodiment, and the following one, the aperture(s) will likely have to open on one edge or the other of the respective front and/or rear cards.

Figure 1F:
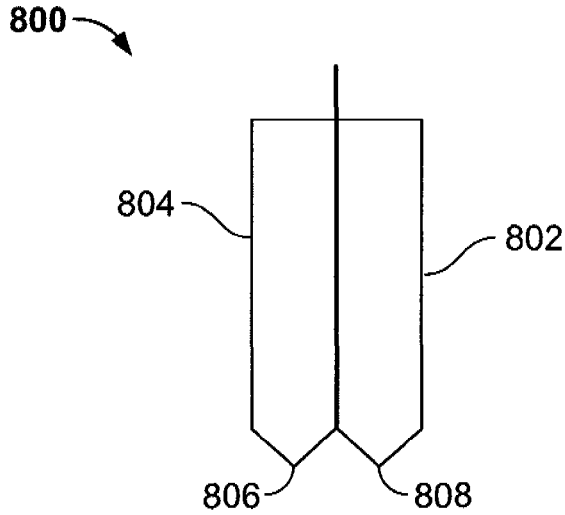
FIG. 1F is a side elevation of a plastic blister cavity according to an alternative embodiment of the invention, wherein the cavity features a downwardly projecting stabilizing portion, in coordination with the blister flange, for enabling the completed package to stand upright without reliance upon a shipping container for support.
Figure 1G:
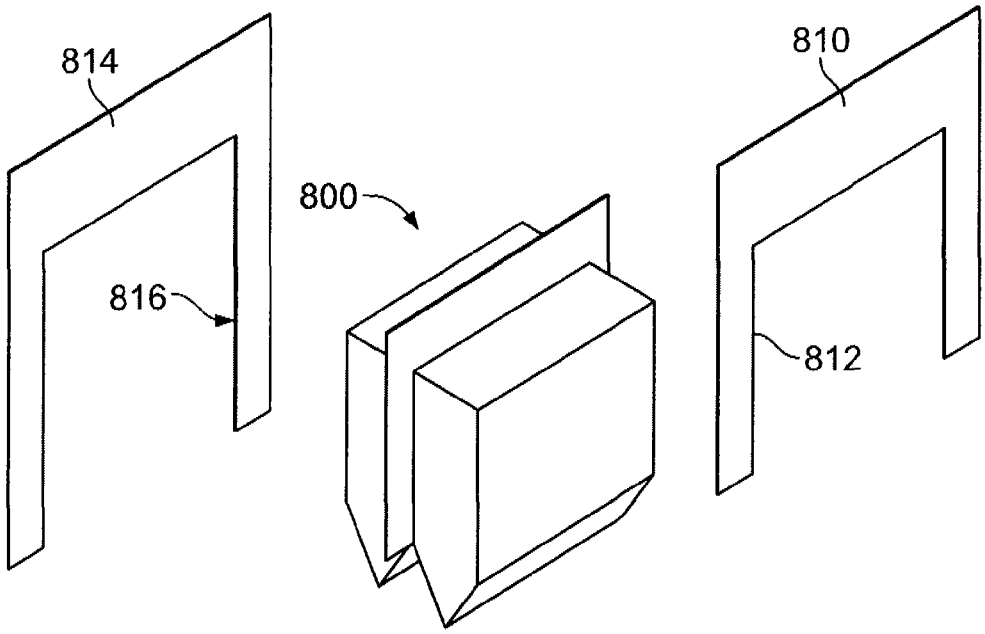
FIG. 1G is a perspective exploded view of a display package using the plastic blister cavity of FIG. 1F.

FIG. 1F is a side elevation of a plastic blister cavity according to an alternative embodiment of the invention, wherein the cavity features front and rear cavity portions 802, 804, having downwardly projecting stabilizing portions 806, 808, respectively, for enabling the completed package to stand upright without reliance upon a shipping container for support. FIG. 1G is a perspective exploded view of a display package using the plastic blister cavity 800 of FIG. 1F, between front card 810 (with downward opening aperture 812) and rear card 814 (having downward opening aperture 816).

Figure 8:
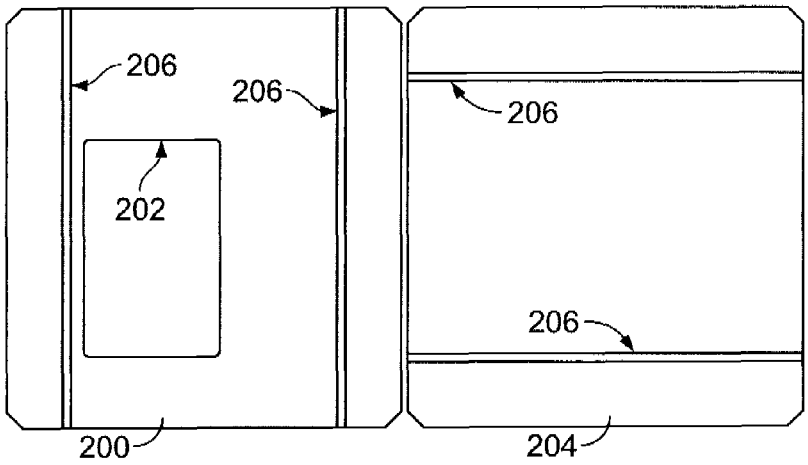
FIG. 8 is a plan view of front and rear cards for a display package according to another alternative embodiment of the invention, in which a security tape is applied to each of the cards, showing in particular the orientation of the cards and their respective security tapes, at the time of assembly of the cards.
Figure 9:
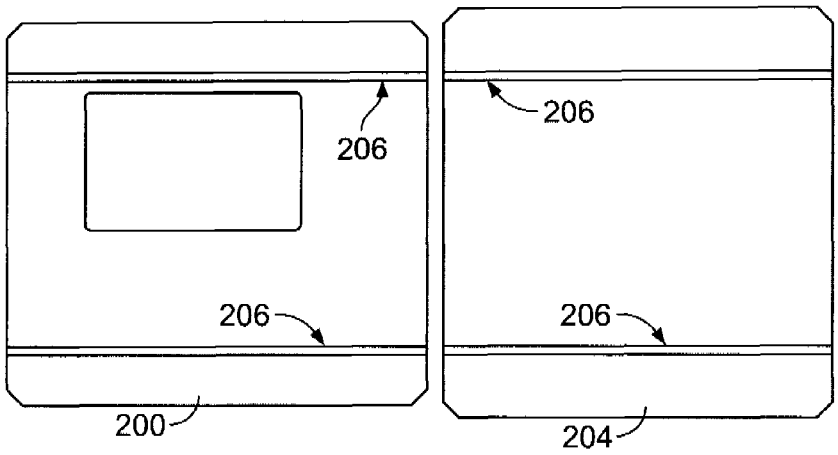
FIG. 9 is a plan view of the front and rear cards of the embodiment of FIG. 8, showing how the cards are oriented at the time of application of the security tape and subsequent die-cutting of the cards, in a facilitated single-pass operation.
Figure 10:
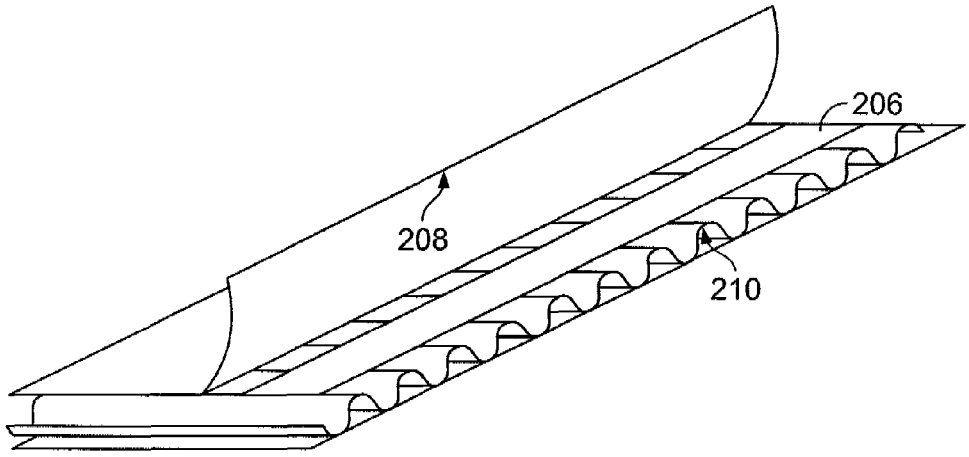
FIG. 10 is a fragmentary, partially exposed perspective view of the portion of a display package employing the cards of the embodiment of FIGS. 8 and 9.

The display package of the embodiment of FIGS. 8–10 is a further alternative embodiment, which incorporates a security feature, which may be employed instead of, or preferably in addition to, the heat-sealing security feature described with respect to the embodiment of FIGS. 1–3. In this embodiment, strips of tear-resistant tape are embedded within the corrugated paperboard material of at least one of, and preferably both of, the front and rear cards of the display package. This provides a tear-stop barrier, preventing a would-be thief from tearing the display package sufficiently to gain access to and free the blister cavity from the front and rear cards. The tear-resistant tapes are preferably formed from reinforce fiber tape, such as tapes by Adalis™ or Sesame® Tape by Linear Products Inc. of Vancouver, Wash.

FIG. 8 illustrates front card 200, having aperture 202, and rear card 204, for a display package according to an alternative embodiment of the invention, in which the inwardly facing surfaces of cards 200, 204 are facing the viewer. The locations of the tear-resistant tapes 206 are indicated, but are understood as preferably not being on the surfaces of the cards 200, 204, but rather are embedded within the corrugated paperboard materials themselves, as shown in FIG. 10, wherein each tear resistant tape 206 is positioned between the inside liner 208 and the corrugated medium 210, for each corrugated paperboard card. Preferably, a quantity of corrugated paperboard is fabricated, having the embedded tear resistant tape, which is then die cut to form front cards 200 and rear cards 204, oriented as shown in FIG. 9, so that the tear-resistant tapes 206 of both cards are parallel to one another. The cards are then rotated 90° relative to one another, as shown in FIG. 8, prior to assembly to form display packages according to this embodiment. It is to be understood that this security tape feature may be used together with or alternatively to, the heat-sealing security method and structure described with respect to the embodiment of FIGS. 1–3.

FIGS. 11A–11D illustrate another alternative embodiment of the invention, in which an alternative security feature is provided. Typically, in the display packages of the present invention, which are illustrated and described herein, aside from the heat sealing material which immediately connects the cards and the blister cavity flanges, adhesive connecting the cards directly to one another may be used sparingly, e.g., in selected spots and/or primarily only around the common peripheral regions of the respective front and rear cards. Such adhesive application also typically exists in prior art sandwiched card-blister flange-card constructions. As such, a would-be thief might be inclined to attempt access to the blister cavity, not by tearing across the width of the sandwiched cards, but instead attempt to separate the front and rear cards, thus exposing the edge of the blister cavity flange, to gain a point of entry to separate the blister cavity flange from the front card, and access the product in the blister cavity. The embodiment of FIGS. 11A–11D addresses this alternative mode of attack.

Figure 11A:
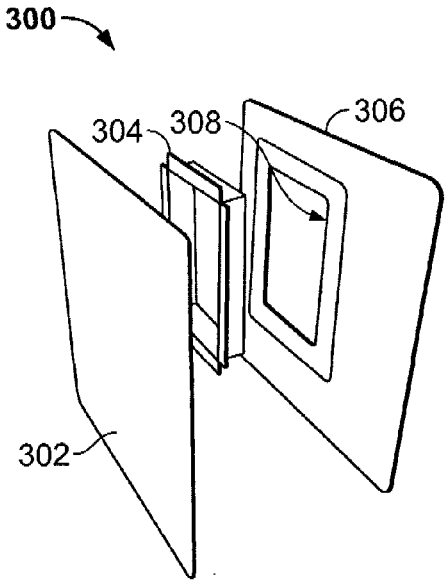
FIG. 11A is an exploded rear perspective view of a display package according to another alternative embodiment of the invention, wherein a safety perforation is formed in the front card to impede unauthorized access to the blister cavity.
Figure 11B:
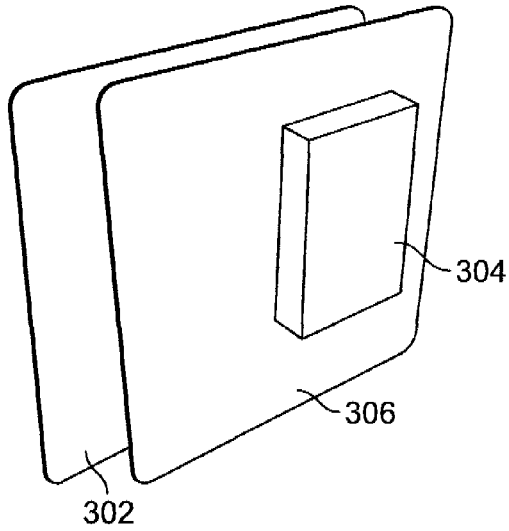
FIG. 11B is a partially exploded front perspective view of the display package of the embodiment of FIG. 11A.
Figure 11C:
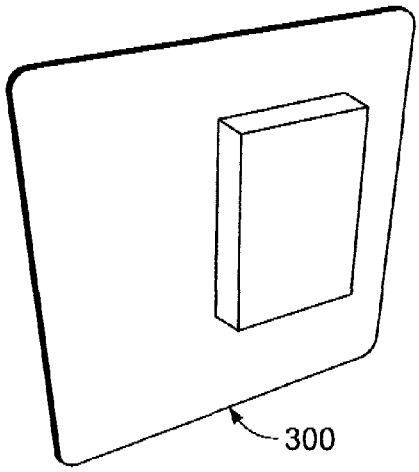
FIG. 11C is a front perspective view of the fully assembled display package of the embodiment of FIG. 11A.

Display package 300 is shown in a rear, perspective exploded view in FIG. 11A. Display package 300 incorporates a rear card 302, which may be a simple planar sheet of single-wall corrugated paperboard material; a blister cavity 304, which may be as described with respect to any of the previously described embodiments; and front card 306 (having aperture 308), which likewise is preferably fabricated from single-wall corrugated paperboard material. The embodiment of FIGS. 11A–11D is distinguished from the prior embodiments by a perforation 310 which is provided on the inwardly-facing surface of front card 306. It is important that perforation 310 not extend completely through the thickness of front card 306; however, the depth to which the perforation does extend may be varied as desired according to the requirements of any particular application. For example, in a version of the embodiment of FIGS. 11A–11D, if a single-wall corrugated paperboard material is used, the perforation 310 may pass through the inner liner and most or all of the way through the corrugated medium, but not through the outer liner.

Furthermore, perforation 310 is spaced, preferably uniformly, a distance away from the edge of aperture 308, which is greater than the width of the flange which surrounds the contoured, three-dimensional portion of blister cavity 304, so that upon assembly of front card 306 to rear card 302, there will be inwardly facing surfaces of the cards, beyond the edge of the blister cavity flange, but within the perimeter defined by the perforation 310, that are immediately juxtaposed against one another. When a display package 300 is assembled and sealed together (FIG. 11C), sealing material is applied in this area and between the cards and adjacent blister cavity flange surfaces (as described with respect to the embodiment of FIGS. 1–3), but not in the areas between the cards that are immediately beyond the perimeter defined by the perforation 310.

Figure 11D:
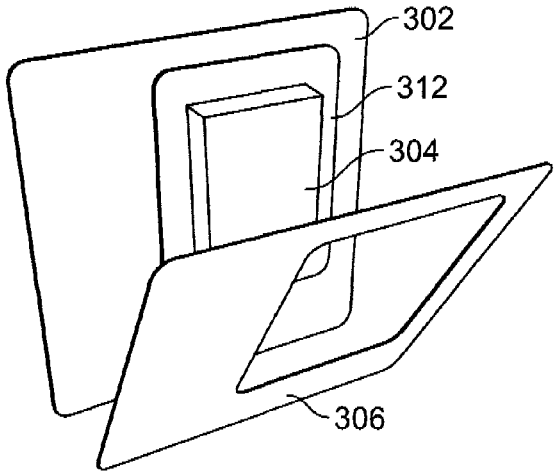
FIG. 11D is a front perspective view of the display package of the embodiment of FIG. 11A, shown after attempted unauthorized access to the blister cavity.

Thus, if a would-be thief does manage to pry a portion of front card 306 away from rear card 302 (as shown in FIG. 11D), the sealed portion 312 of front card 306 that is within the perimeter, tears away from card 306 and remains affixed to the rear card 302, and the front-facing surface of the blister cavity flange. In this way, the outer edge of the blister cavity flange is still protected and access to the blister cavity flange edge prevented, by the portions of the front and rear cards which are directly sealed to one another in the area immediately to the outside of the edges of blister cavity flange, but within the perimeter defined by the perforation 310.

While in a preferred embodiment of the invention, perforation 310 is formed as a series of small spaced apart cuts extending partially but not completely through the thickness of the front card, in alterative embodiments of the invention, other lines of weakness, such as a continuous partial cut-through or a sharp, deep score, may be employed, so long as the result is that the portion of the front card which is sealed to the flange of the blister cavity remains affixed thereto, upon removal of the remainder of the front card from the display package.

Figure 13:
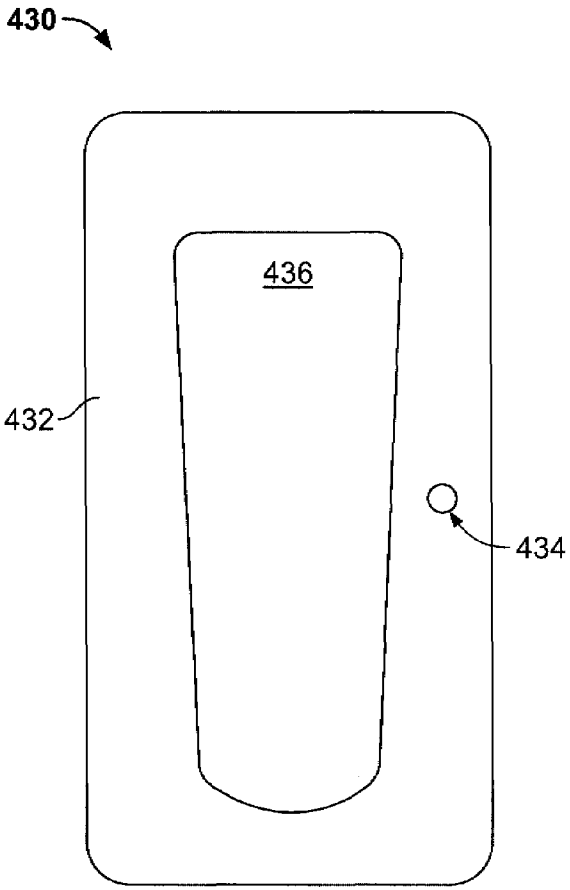
FIG. 13 is a plan view of a blister cavity for use with the composite front and rear card of the display package of the embodiment of FIG. 12.
Figure 12:
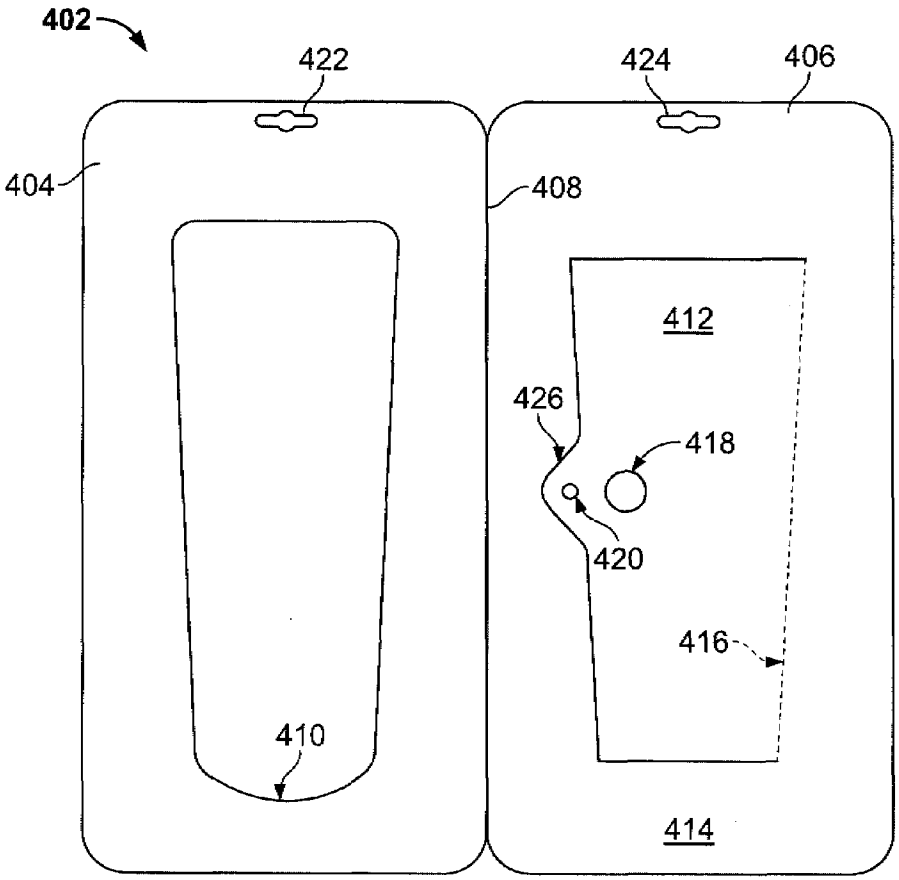
FIG. 12 is a plan view of a composite front and rear card for a reclosable display package according to another alternative embodiment of the invention.
Figure 14:
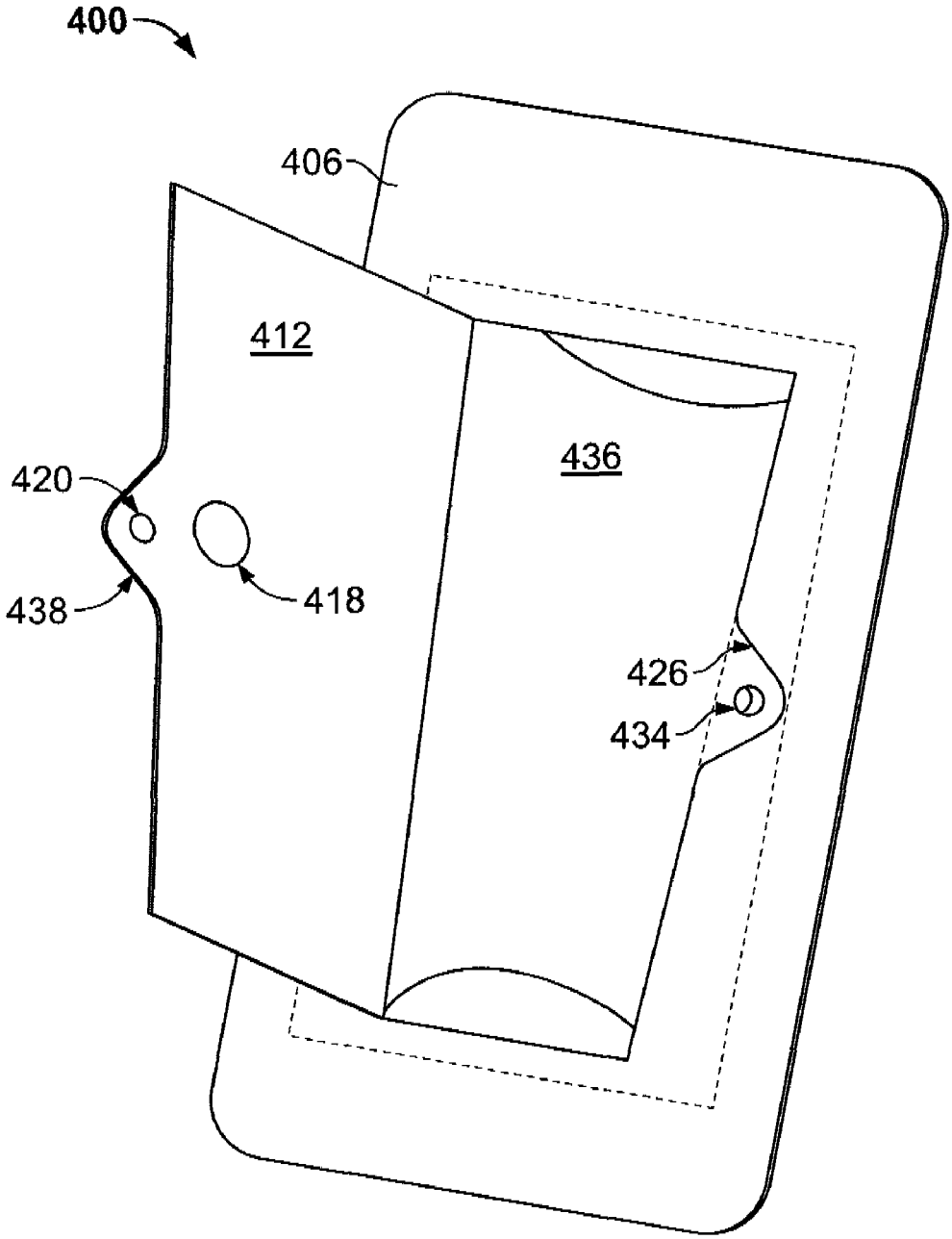
FIG. 14 is a rear perspective view of an assembled reclosable display package according to the embodiment of FIGS. 12 and 13, showing the access door of the reclosable display package in its open configuration.

The display package 400 of FIGS. 12–14 is according to another embodiment of the invention, wherein reclosability and repeated access to the interior of the blister cavity is facilitated by the presence of a reclosable access door. Display package 400 incorporates combined card 402 (viewed from the inside in FIG. 12), having front card portion 404 and rear card portion 406, joined along fold line 408. Front card portion 404 includes blister cavity aperture 410. Rear card portion 406 includes access door 412, that joins peripheral portion 414 along fold line 416. Access door 412 includes finger receiving opening 418, and snap aperture 420. In addition, card 402 may be provided with hanging hook apertures 422, 424.

FIG. 13 illustrates, from a rear plan view, a blister cavity 430 for use in combination with the combined card 402. Blister cavity 430 includes flange 432 and contoured, three-dimensional portion 436. A snap projection 434, which may be generally cylindrical with a circumferentially disposed bump or notch (so that at least a portion, but not all of snap projection 434 has a diameter greater than the diameter of snap aperture 420), is preferably molded into the surface of flange 432, and extending away from the plane of the flange 432, toward the observer of FIG. 13. Snap projection 424 is preferably configured to permit alignment with and releasably retaining insertion into snap aperture 420.

Upon assembly of combined card 402 and blister cavity 430, contoured, three-dimensional portion 436 of blister cavity 430 is inserted through aperture 410. Rear portion 406 of card 402 is folded over, along fold line 408, so that cut-away 426 aligns generally with and accommodates snap projection 434. Cut-away 426 forms tab 438 on access door 412. Flange 432 becomes captured between and is preferably affixed to front portion 404 and rear portion 406, in the manner described with respect to the embodiment of FIGS. 1–3. Tab 438 of access door 412 is preferably not affixed to flange 432 in the area adjacent to male snap member 434. When rear portion 406 is fully folded over, and affixed to front portion 404 (after placement of product within contoured portion 436), snap aperture 420 aligns with and is "popped" down over snap projection 434.

After the product has been purchased, access door 412 is opened simply by placing a fingertip in finger receiving opening 418, and door 412 is pulled open. The product may be removed, used, and replaced in portion 436, and then door 412 reclosed by pressing down, until snap opening 420 pops over snap projection 434.

In addition to the reclosure feature, the embodiment of FIGS. 12–14, may include the sandwich sealing feature of the embodiment of FIGS. 1–3, the high-density packaging feature of FIGS. 4–7, and/or the security features of FIGS. 8–11D.

Figure 16:
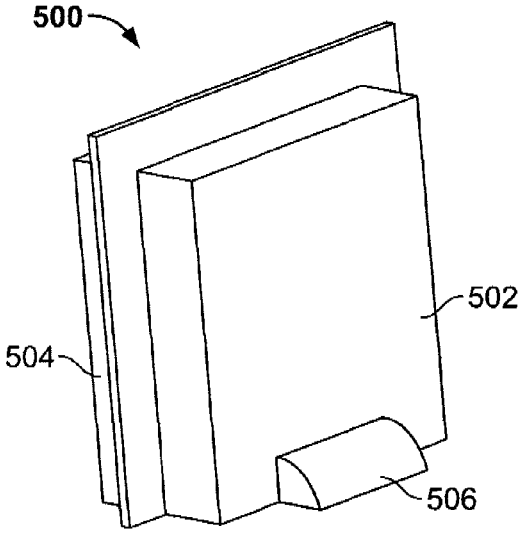
FIG. 16 is a rear perspective view of a plastic blister, according to an alternative embodiment of the invention, in which a stabilizing projection extends outwardly from one of the projecting contoured portions of the blister.
Figure 17:
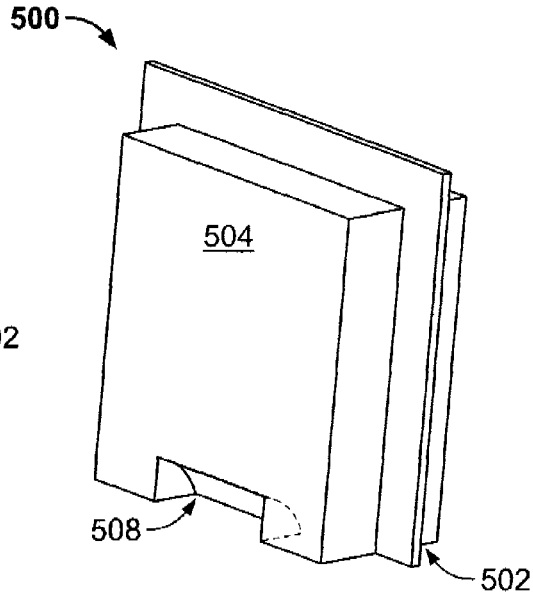
FIG. 17 is a front perspective of the plastic blister according to the embodiment of FIG. 16, in which a recess having a complementary configuration to the stabilizing projection shown in FIG. 16, is disposed in the opposing projecting contoured portion of the blister.
Figure 18:
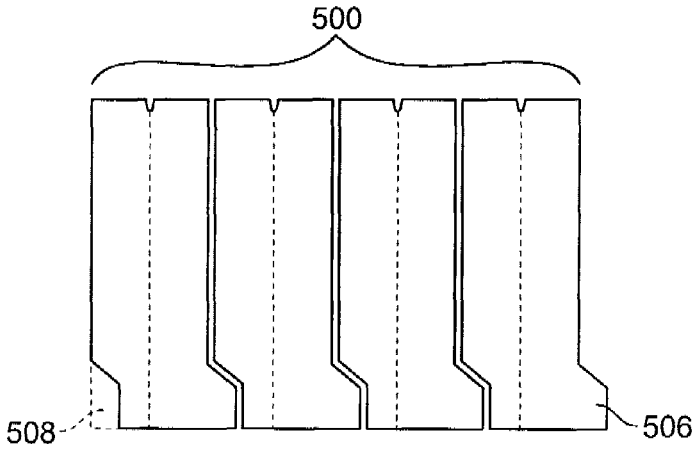
FIG. 18 is a side elevation, in section, showing how a plurality of plastic blisters according to the embodiment of FIGS. 16–17 are configured to nest, front-to-back, in a space-saving high density arrangement.

FIGS. 16–18 illustrate a plastic blister construction for a blister having two opposing outwardly projecting contoured portions, which features a stabilizing feature. Blister 500 may be used alone as an all-plastic display package, or in combination with front and rear (preferably corrugated) paperboard cards not shown). Blister 500 may be formed as a single piece, hinged along one side thereof, or as two separate pieces which are heat sealed together, along their respective peripheral flanges, either before, or at the same time as the heat sealing of the plastic blister generally, to the front and rear cards. In either configuration, each blister 500 includes a first projecting contoured portion 502, and a second projecting contoured portion 504. Although FIG. 16 is nominally considered to be a front view and FIG. 17 a rear view, these designations may be reversed, as desired, depending upon the aesthetic and structural requirements of any particular package configuration.

In an alternative preferred embodiment of the invention, shown in FIGS. 16–18, is an alternative blister construction having enhanced stacking and nesting characteristics.

In some prior art plastic clamshell packaging schemes, the plastic blisters are placed in an open topped displayable tray, with a slotted insert, configured to receive the side edges of the flanges of the blister, to keep the blisters in an upright orientation for maximum exposure and easy access for the consumer.

First projecting contoured portion 502 includes a further, outwardly projecting stabilizing "foot" 506, which may be of any desired shape, except that foot 506 should not extend the entire width of contoured portion 502. Second projecting contoured portion 504 includes an inwardly extending concavity 508, which has a configuration that is complementary to the shape of foot 506. Again, concavity 508 should not extend across the entire width of contoured portion 504. As can be seen, foot 506 causes blister 500 to have a greater length of material that is in contact with the supporting surface underneath, and thus has enhanced stability and resistance to tipping.

The reason concavity 508 should not extend across the entire width of contoured portion 504 is that would have the effect of shortening the length of contoured portion 504 that rests on the supporting surface, thus reducing stability of blister 500. Further foot 506 should have a transverse (side to side) length that is less than the transverse length of concavity 508, so that foot 506 will always "fit into"

concavity 508, when two or more blisters 500 are placed front-to-back, as shown in FIG. 18.

A benefit of the blister construction of FIGS. 16–18, is the elimination of the need for a slotted insert for a display tray for holding a plurality of blisters 500 (whether captured in a paperboard card or not), and increasing vertical stability of the blister itself. By enabling the blisters to be nested as shown, use of space inside the surrounding shipping/display container is optimized, permitting more blisters to be put in each such shipping/display container, lowering logistics costs and increasing retail area profitability.

The foregoing description and drawings merely explain and illustrate the invention, and the invention is not limited thereto, except as those skilled in the art who have the present disclosure before them will be able to make modifications and variations therein without departing from the scope of the invention.

What is claimed is:

1. A display package, comprising:

a blister cavity, having a contoured, three-dimensional portion operably configured to receive at least one product, and through which the at least one product may be visually inspected, wherein the blister cavity further having a peripheral flange extending outwardly from at least a portion of the contoured, three-dimensional portion;

a front card, having an aperture, through which the contoured, three-dimensional portion of the blister cavity projects, and further having a rearwardly facing surface, against which a forwardly facing surface of the peripheral flange is juxtaposed;

a rear card, having a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards;

the blister cavity being fabricated from a material that is at least one of transparent, and translucent;

the front and rear cards each being fabricated at least in part from corrugated paperboard, wherein the corrugations of the corrugated paperboard of the front card extending transversely to the corrugations of the corrugated paperboard of the rear card; and at least one tear-resistant security tape embedded within at least one of the corrugated paperboard of the front card and the corrugated paperboard of the rear card, wherein the at least one tear-resistant security tape extending transversely to the corrugations of the corrugated paperboard embedded therein.

2. The display package according to claim 1, wherein the corrugations of the corrugated paperboard of the front card extend perpendicular to the corrugations of the rear card.

3. The display package according to claim 1 further comprising a first tear-resistant security tape embedded within the corrugated paperboard of the front card and a second tear-resistant security tape embedded within the corrugated paperboard of the rear card, wherein the first tear-resistant security tape extending transversely to the corrugations of the corrugated paperboard of the front card and the second tear-resistant security tape extending transversely to the corrugations of the corrugated paperboard of the rear card.

4. The display package according to claim 3 wherein the front and rear cards each including two pair of opposing edges, wherein the first tear-resistant security tape extends between opposing edges of the front card, and the second tear-resistant security tape extends between opposing edges of the rear card.

5. The display package according to claim 1 wherein the front and rear cards each including two pairs of opposing edges, wherein the display package further comprising a plurality of tear-resistant security tapes embedded within the corrugated paperboard of at least one of the front card and the rear card, each tear-resistant security tape extending transversely to the corrugations and between opposing edges of the corrugated paperboard embedded therein.

6. The display package according to claim 5 wherein the plurality of tear-resistant security tapes are positioned such that at least one tear-resistant security tape is positioned on each side of the blister cavity.

7. A display package for the containment and display of at least one product for sale, the display package comprising:

a blister cavity, having a contoured, three-dimensional portion operably configured to receive the at least one product, and through which the at least one product may be visually inspected, the blister cavity further having a peripheral flange extending outwardly from at least a portion of the contoured, three-dimensional portion;

a front card, having an aperture, through which the contoured, three-dimensional portion of the blister cavity projects, and further having a rearwardly facing surface, against which a forwardly facing surface of the peripheral flange is juxtaposed;

a rear card, having a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards;

the blister cavity being fabricated from a material that is at least one of transparent and translucent;

the front and rear cards being fabricated from corrugated paperboard;

at least one tear-resistant security tape embedded within at least one of the corrugated paperboard of the front card and the corrugated paperboard of the rear card; and a heat-seal coating covering a portion of the rearwardly facing surface of the front card including an area juxtaposed to the forwardly facing surface of the peripheral flange and covering a portion of a forwardly facing surface of the rear card including an area juxtaposed to a rearwardly facing surface of the peripheral flange;

wherein the front card, the peripheral flange, and the rear card are heat-sealed together.

8. The display package according to claim 7, wherein the blister cavity is fabricated from a plastic material.

9. The display package according to claim 7, wherein the corrugated paperboard material is single wall corrugated paperboard material.

10. A display package for the containment and display of at least one product for sale, the display package comprising:

a blister cavity, having a contoured, three-dimensional portion operably configured to receive the at least one product, and through which the at least one product may be visually inspected, the blister cavity further having a peripheral flange extending outwardly from at least a portion of the contoured, three-dimensional portion;

a front card, having an aperture, through which the contoured, three-dimensional portion of the blister cavity projects, and further having a rearwardly facing surface, against which a forwardly facing surface of the peripheral flange is juxtaposed;

a rear card, having a peripheral contour which is substantially similar to a peripheral contour of the front card, the rear card being disposed in overlying relation to the rearwardly facing surface of the front card and affixed thereto, so that the peripheral flange of the blister cavity is sandwiched between the front and rear cards;

the blister cavity being fabricated from a material that is at least one of transparent and translucent;

the front and rear cards being fabricated from corrugated paperboard;

at least one tear-resistant security tape embedded within at least one of the corrugated paperboard of the front card and the corrugated paperboard of the rear card, wherein the at least one tear-resistant security tape extending transversely to the corrugations of the corrugated paperboard embedded therein; and a heat-seal coating covering a portion of the rearwardly facing surface of the front card including an area juxtaposed to the forwardly facing surface of the peripheral flange and covering a portion of a forwardly facing surface of the rear card including an area juxtaposed to a rearwardly facing surface of the peripheral flange;

wherein the front card is sealed to the forwardly-facing surface of the peripheral flange of the blister cavity, and the rear card is sealed to the rearwardly-facing surface of the peripheral flange of the blister cavity.

* * * * *